US007342542B2

(12) United States Patent
Sadamori et al.

(10) Patent No.: US 7,342,542 B2
(45) Date of Patent: Mar. 11, 2008

(54) ANTENNA

(75) Inventors: Hideto Sadamori, Okayama (JP); Yoshinobu Nakagawa, Osaka (JP); Setsuo Takesako, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 123 days.

(21) Appl. No.: 11/285,626

(22) Filed: Nov. 22, 2005

(65) Prior Publication Data

US 2006/0139219 A1 Jun. 29, 2006

(30) Foreign Application Priority Data

Dec. 27, 2004 (JP) ..... 2004-376046
Apr. 27, 2005 (JP) ..... 2005-129281

(51) Int. Cl.
*H01Q 1/24* (2006.01)

(52) U.S. Cl. ..... 343/702; 343/702

(58) Field of Classification Search ..... 343/700 MS, 343/702

See application file for complete search history.

(56) References Cited

U.S. PATENT DOCUMENTS 6,486,837 B2 * 11/2002 Spiegel et al. ..... 343/702
6,885,347 B2 * 4/2005 Zheng et al. ..... 343/702
7,151,493 B2 * 12/2006 Wen et al. ..... 343/700 MS

FOREIGN PATENT DOCUMENTS

JP 2003-032022 1/2003
KR 20-0356488 7/2004

* cited by examiner

*Primary Examiner*—Trinh Dinh
*Assistant Examiner*—Dieu Hien T Duong
(74) *Attorney, Agent, or Firm*—RatnerPrestia

(57) ABSTRACT

A first antenna element is formed by a press-fitting first member and a second member to each other, and a second antenna element is formed by press-fitting a first member and a second member to each other. Respective members are fixed to a base by riveting, thereby achieving the antenna. This structure allows determining arbitrarily splitting positions and shapes of members of the first antenna element and the members of the second antenna element. The antenna can be obtained at an inexpensive cost even if an external appearance of the antenna is specified to be an irregular shape.

12 Claims, 9 Drawing Sheets

ANTENNA

FIELD OF THE INVENTION

The present invention relates to antennas to be used in portable phones or radio devices for mobile communications.

BACKGROUND OF THE INVENTION

Mobile communication terminals including portable phones have been downsized and lightened, so that antennas which transmit and receive radio waves are required to be smaller in size and lightened of their weight. A major style of antenna is a built-in antenna, namely, an antenna is always accommodated in a housing of the mobile communication terminal.

FIG. 11 shows a perspective view illustrating a conventional built-in antenna. Antenna element 1 is formed of long and narrow strip of metal plate bent several times over for resonating with radio-wave having a given frequency. The top view of antenna element 1 shows a zigzag line. Base 2 is made of resin and antenna element 1 is fixed thereto. Base 2 shapes like a rectangle which covers the periphery except one end of antenna element 1. Base 2 is generally formed by an insert molding method.

Antenna element 1 has coupling terminal 3 at its one end, and terminal 3 protrudes from a lateral face of base 2 to the outside, so that conventional antenna 5 has a mono-pole structure. Such conventional antenna 5 is coupled to a circuit pattern of a circuit board (not shown) disposed in a housing (not shown) of the device at its coupling terminal 3 by soldering. Antenna 5 is thus always accommodated in the housing of the device and coupled mechanically as well as electrically to the circuit of the device via coupling terminal 3. A given operation to the device by its user allows the device to receive or transmit radio wave via antenna 5, so that the user can start communication. Meanwhile, Japanese Patent Application Non-examined Publication No. 2003-32022 is prior art of the present invention.

Since mobile communication devices including portable phones have been rapidly downsized and lightened recently, a place for accommodating the built-in antenna has been gradually reduced in the device, and yet, the rectangular volumetric-shape is not always kept but an irregular shape is often prepared for the antenna.

When an external appearance of an antenna is designed to be an irregular shape, conventional antenna 5 needs to adjust each one of bent points of the zigzag of antenna element 1 to fit the external appearance of the antenna. If the insert molding method is used for burying antenna element 1 in base 2, an insert metal-mold having complicated press-pin positions is required. As a result, antenna 5 becomes expensive.

SUMMARY OF THE INVENTION

An antenna of the present invention comprises the following elements:

an antenna element made from metal plate; and a base to which the antenna element is fixed.

The antenna element is formed of plural members, and one of the members has a power feeder at its end, an the power feeder is coupled electrically to joining sections provided to respective ends of the plural members, and each of the plural members are fixed to the base by riveting. The antenna of the present invention preferably has the joining section in a protective hole extending through the base.

The antenna of the present invention preferably includes press-fit joining sections where each one of plural members are coupled together at the respective joining sections by press-fitting. Faces of the plural members of the antenna are preferably fixed to the base by riveting, and the respective faces preferably confront each other such that they sandwich the base, and the respective faces are placed such that they form right angles with the press-fit joining sections.

DESCRIPTION OF REFERENCE MARKS

Figure 1:
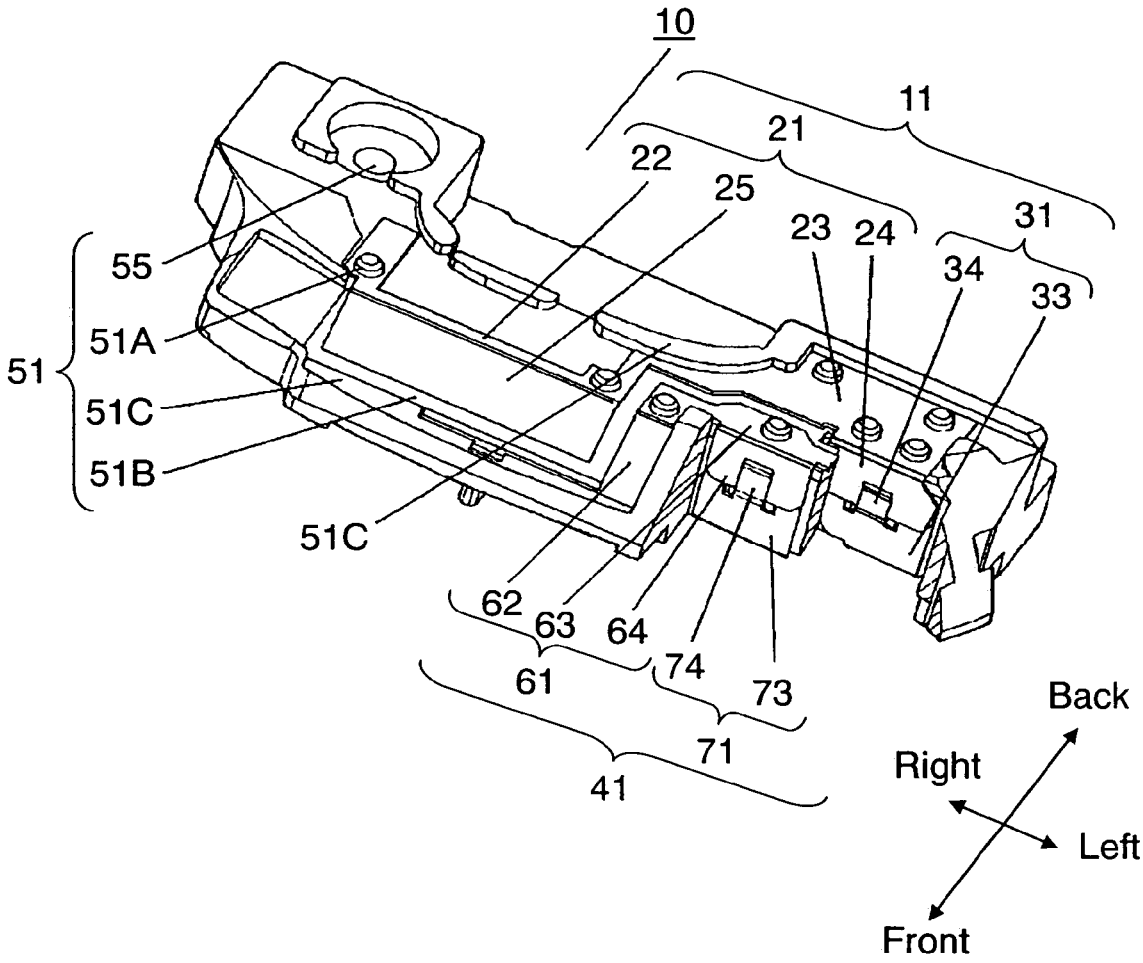
FIG. 1 shows a perspective view illustrating an external appearance of an antenna in accordance with a first exemplary embodiment of the present invention, and the view is taken obliquely from the front and over the antenna and shows a sectional view of an essential part of the antenna.

10, 80 antenna
11 first antenna element
21, 61, 91 first member
22, 62, 92 linear section of the first member
62B, 62C linear area of the first member
22A, 23A, 62A, 63A, 91A through hole of the first member
23, 63, 93 joining section of the first member (fixing section)
24, 64 press-fitting plate section of the first member (joining section)
25 slanting face of the first member
31, 71, 101 second member
32, 72, 102 joining section of the second member (fixing section)

32A, 72A, 101A through hole of the second member
33, 73 vertical section of the second member
34, 74 claw section of the second member (joining section)
34A, 34C terminal claw
34B center claw
35, 75, 105 leaf spring section of the second member (plate section)
41 second antenna element
51, 81 base
51A, 81A riveting protrusion
51B slant face
51C wall section
52, 85 protective hole
55 hole
82 antenna element
94 urging plate section of the first member
95 face section of the first member
103 elastic tab of the second member
104 frame-like vertical section of the second member

DETAILED DESCRIPTION OF THE PREFERRED EMBODIMENTS

Exemplary Embodiment 1

Figure 2:
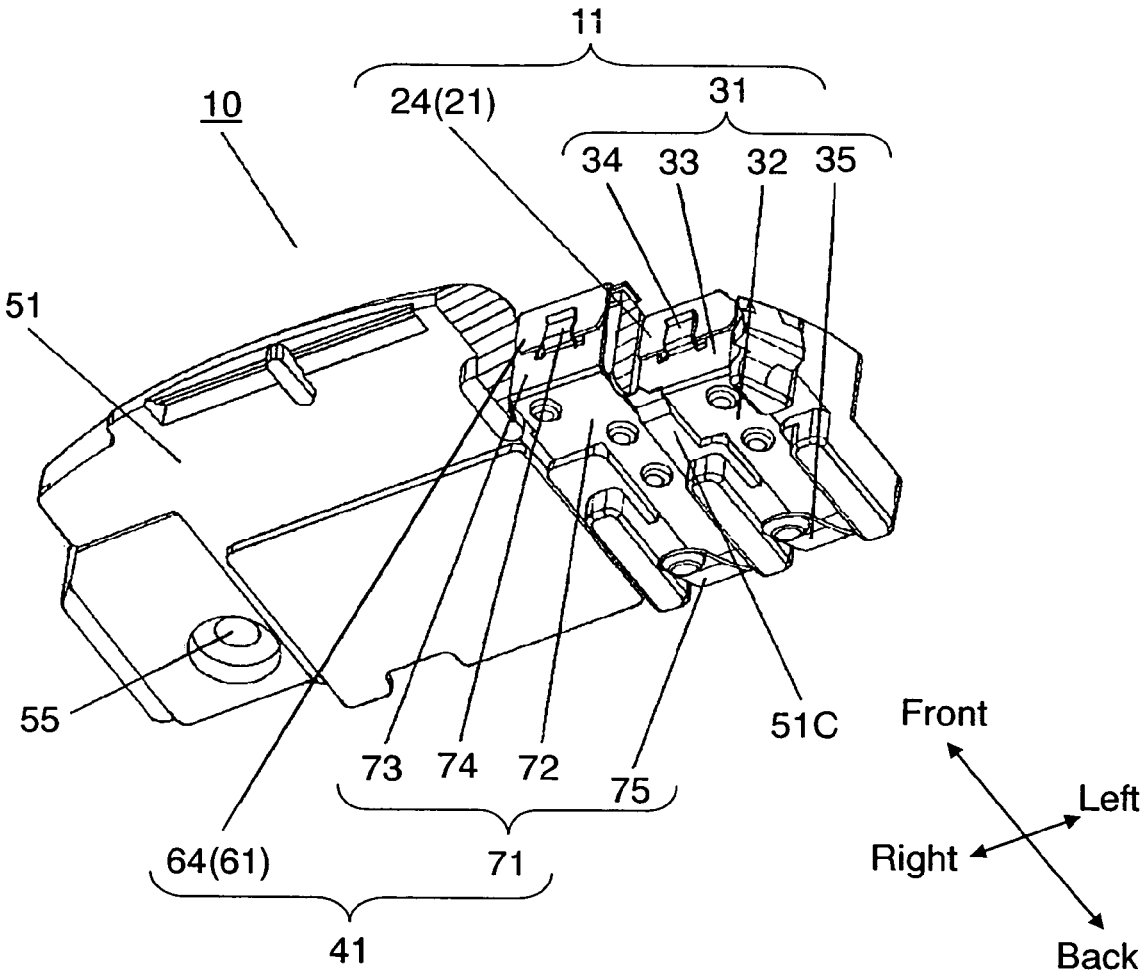
FIG. 2 shows a perspective view illustrating an external appearance of the antenna in accordance with the first embodiment, and the view is taken obliquely from the front and under the antenna and shows a sectional view of an essential part of the antenna.
Figure 3:
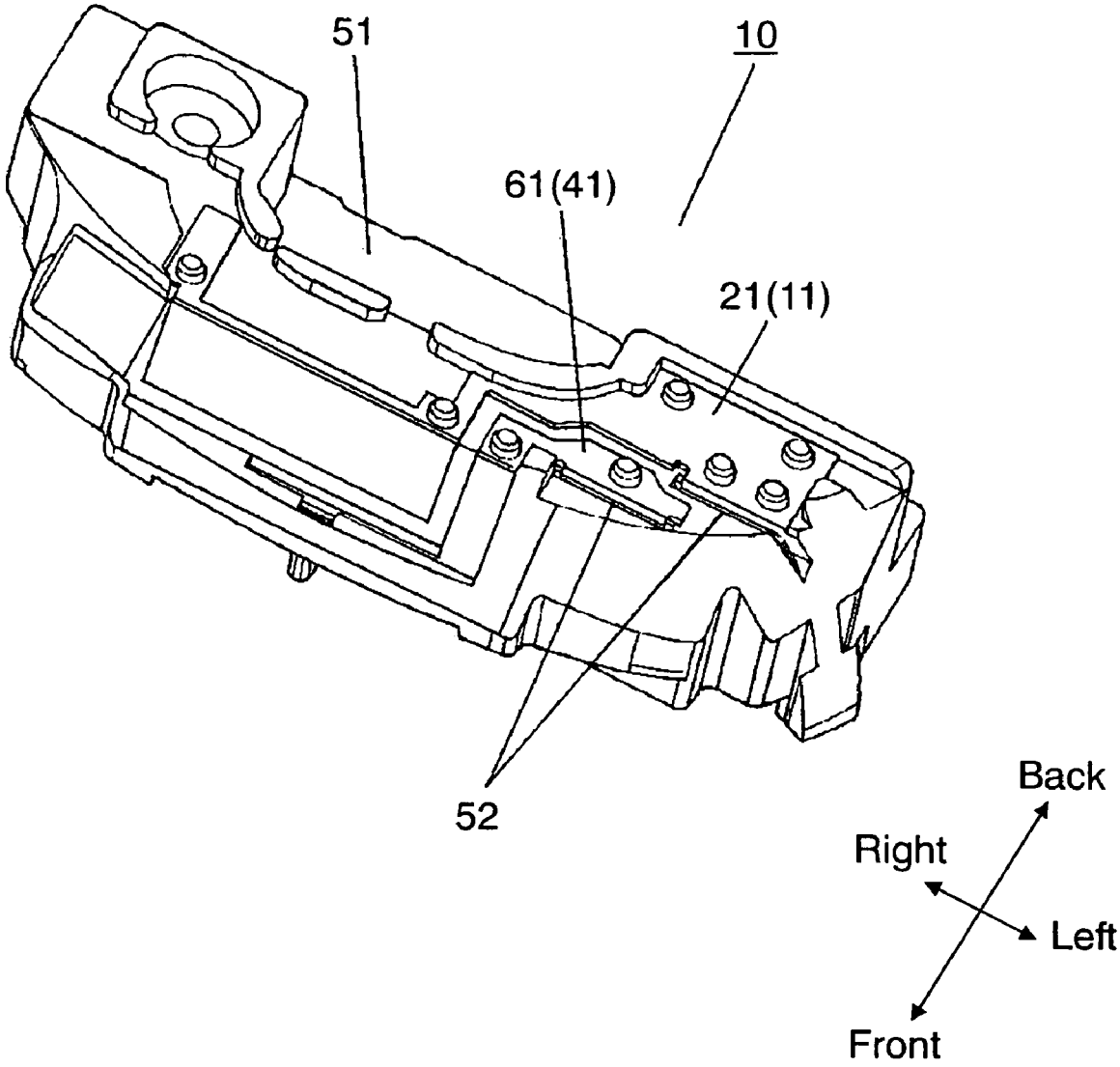
FIG. 3 shows a perspective view illustrating the antenna shown in FIG. 1, and the view is taken from obliquely the front and over the antenna.
Figure 4:
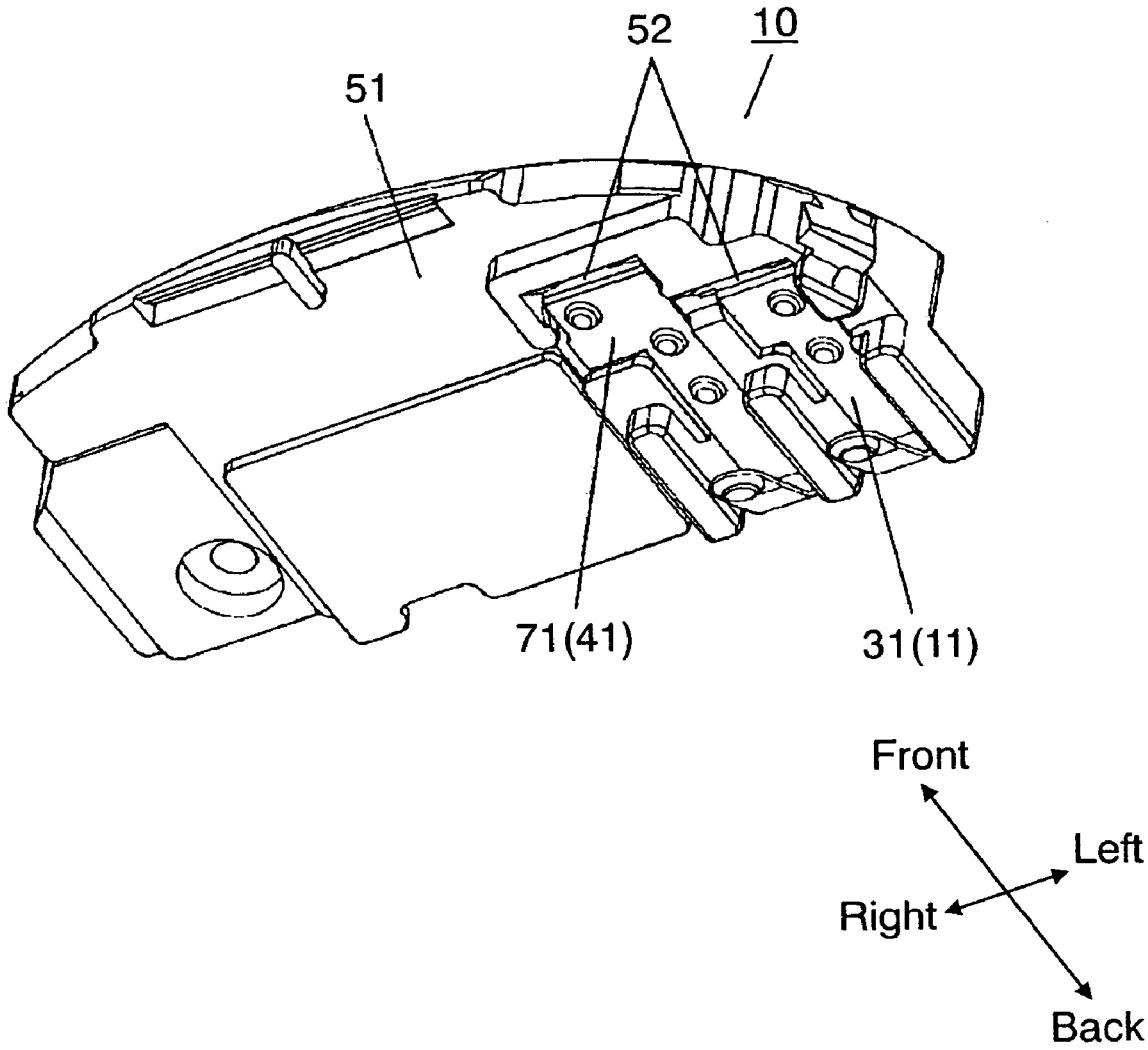
FIG. 4 shows a perspective view illustrating the antenna shown in FIG. 1, and the view is taken obliquely from the front and under the antenna.
Figure 5:
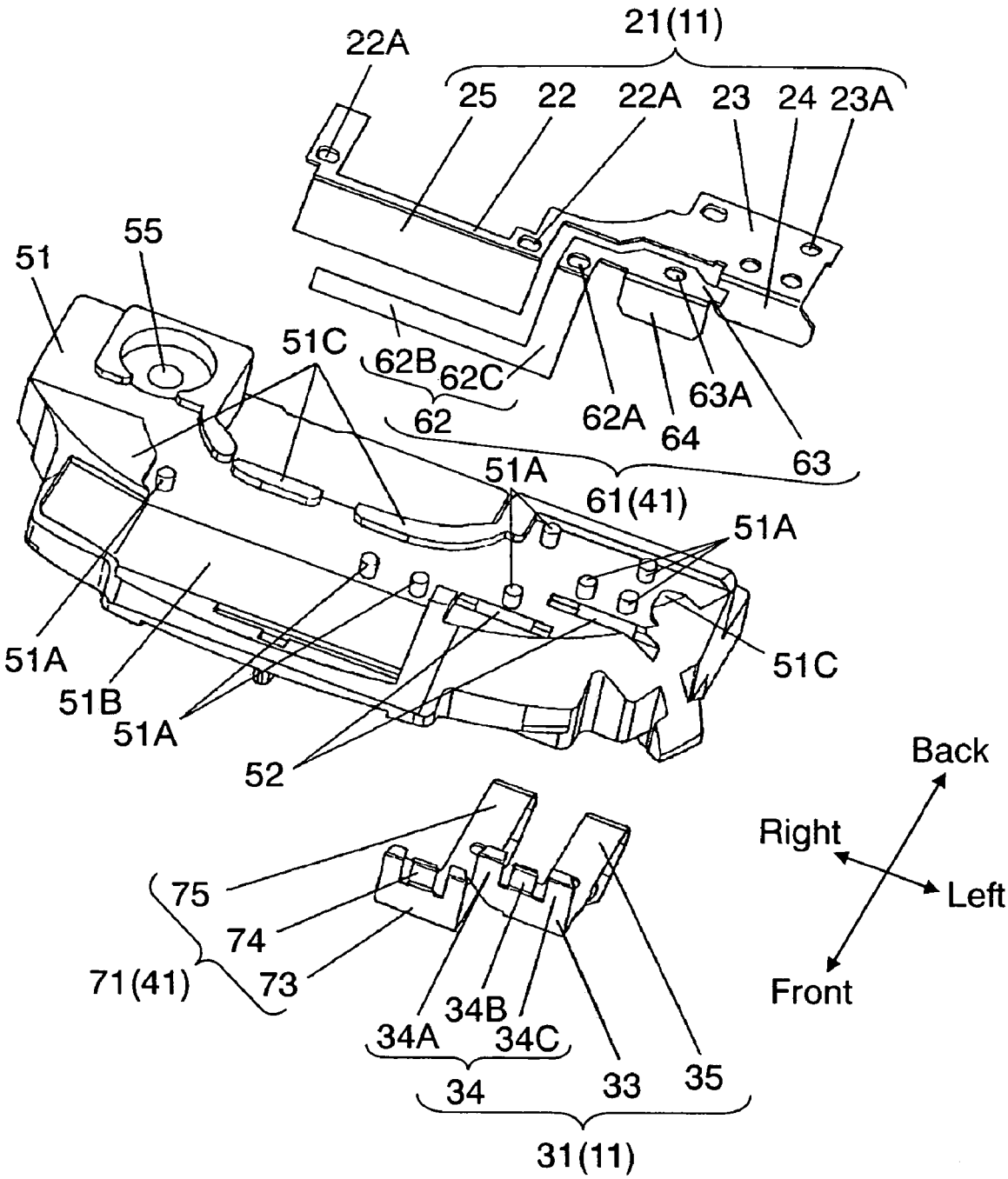
FIG. 5 shows an exploded view of the antenna shown in FIG. 1, and the view is taken obliquely from the front and over the antenna.
Figure 6:
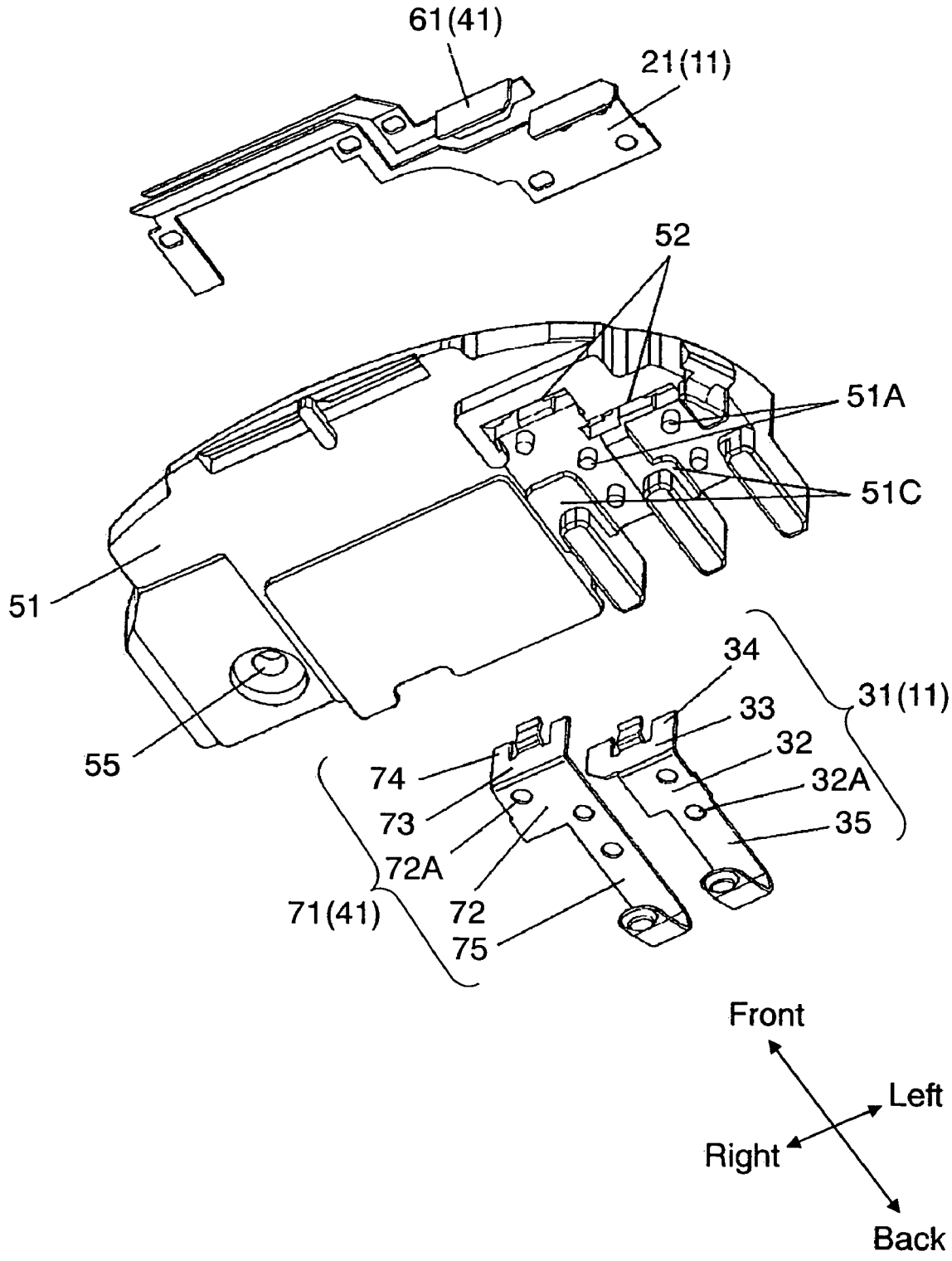
FIG. 6 shows an exploded view of the antenna shown in FIG. 1, and the view is taken obliquely from the front and under the antenna.
Figure 7:
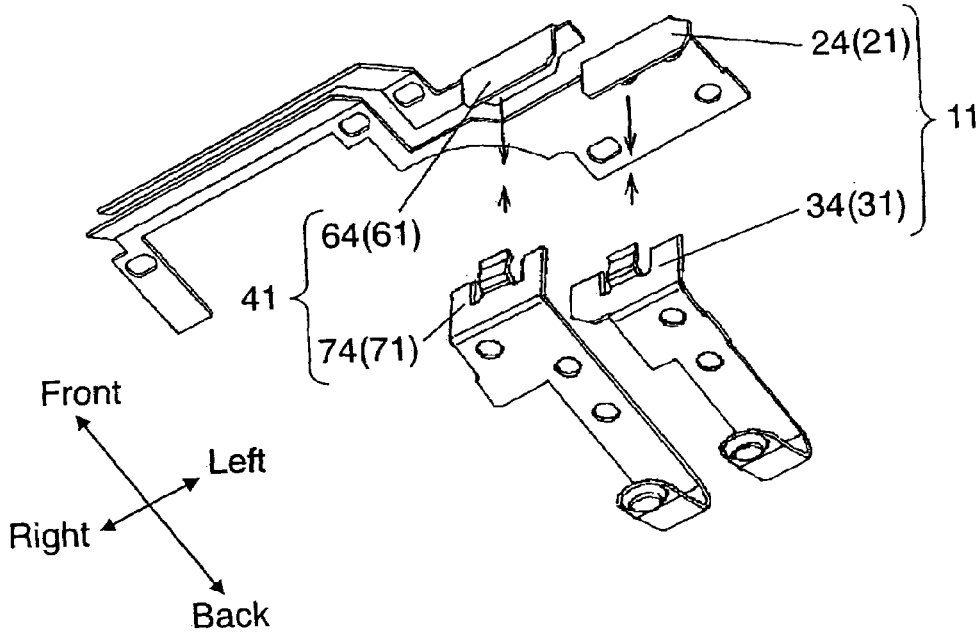
FIG. 7 shows a perspective view illustrating respective members of a first and a second antenna elements, i.e. essential parts of the antenna, being ready to be press-fitted for joining.

FIG. 1 shows a perspective view illustrating an essential part of the antenna in accordance with the first embodiment in an external appearance viewed obliquely from the front and over the antenna. FIG. 2 shows a perspective external view illustrating an essential part of the antenna in accordance with the first embodiment, and the view is taken obliquely from the front and under the antenna. FIG. 3 shows a perspective view illustrating an external view of the antenna viewed obliquely from the front and over the antenna. FIG. 4 shows a perspective external view illustrating the antenna viewed obliquely from the front and under the antenna. FIG. 5 shows an exploded view of the antenna viewed obliquely from the front and over the antenna. FIG. 6 shows an exploded view of the antenna viewed obliquely from the front and under the antenna. FIG. 7 shows a perspective view illustrating respective members of a first and a second antenna elements, i.e. essential parts of the antenna, being ready to be press-fitted to each other for joining.

Antenna 10 of the present invention is a built-in type antenna and accommodated in a housing (not shown) of a portable phone. Antenna 10 is mounted in the housing such that the front side of antenna 10 shown in FIG. 1-FIG. 4 confronts the upper end of the housing.

A projection plan view of antenna 10 shapes like an arc to be fit to an upper end of the portable phone, and recesses are provided at given places on the lateral faces of the front so that antenna 10 will not hit any part in the housing. A thickness of antenna 10 tapers toward the front end, and yet, recesses as well as projections are provided at given places at the back of antenna 10 in order to avoid hitting the housing or a printed circuit board accommodated in the housing. As a result, antenna 10 is obliged to shape not like a rectangular form but like an irregular form.

Base 51 made of insulating resin is formed to fit to antenna 10 having the designated shape discussed above. As shown in FIGS. 3 and 4, first antenna element 11 and second antenna element 41 are respectively fixed to base 51 by riveting.

First antenna element 11 is formed by press-fitting first member 21 and second member 31 together as shown in FIG. 7, both of which members have been formed individually. The press-fit joining sections are provided in protective holes 52 extending through base 51 vertically at the left front of base 51 as shown in FIGS. 3 and 4. FIGS. 1 and 2 shows perspective views with a front lateral wall removed in order to show the joining sections more clearly. Meanwhile the front lateral wall forms protective hole 52.

As shown in FIG. 1, first member 21 is placed on a top face of base 51. Member 21 includes linear section 22 having a given width, joining section 23 shaping like a rectangle extended from linear section 22 and formed on the same plane as linear section 22, and flat press-fitting plate section 24 bent downward at right angles with respect to joining section 23. Plate section 24 is placed such that it can be accommodated in protective hole 52 of base 51. On top of that, slanting face 25 protrudes from the front of linear section 22. Slanting face 25 is bent downward at a given angle from linear section 22 toward base 51 as shown in FIG. 1. First member 21 is unitarily formed by punching and bending a good conductive metal plate including copper.

As FIG. 5 shows, through holes 22A for riveting are provided in the vicinity of both ends of linear section 22 of first member 21, and through holes 23A for riveting are provided in the vicinity of respective corners of joining section 23.

First member 21 is combined with base 51 such that plate section 24 is inserted into protective hole 52 downward from the top face of base 51. At this time, cylindrical protrusions 51A for riveting are provided on the top face of base 51 shown in FIG. 5, and protrusions 51A correspond to through holes 22A, 23A. Protrusions 51A are inserted into holes 22A, 23A, and the ends of protrusions 51A are riveted, so that first member 21 is fixed to base 51.

Base 51 has slanting face 51B at its top front, and slanting face 51B slants downward toward the front. The angle formed by linear section 22 and slanting face 25 agrees with the angle formed by the top face of base 51 and slanting face 51B. Slanting face 25 is placed on slanting face 51B with first member 21 fixed to base 51. The presence of slanting face 25 forms plural conductive paths having different lengths when the antenna works, so that the antenna can have a wider bandwidth. Adjustment of the placement, size, or angle of slanting face 25 allows fine adjustments of the antenna characteristics.

As discussed above, first member 21 is fixed to base 51 by riveting except plate section 24 which is inserted into hole 52. Wall section 51C is provided to base 51 so that the periphery of first member 21 fixed to the top face of base 51 cannot protrude outside of base 51 because wall section 51C surrounds the periphery. When antenna 10 is mounted to a mobile communication device, a finger of workers snags on parts of the periphery of first member 21, so that the fixed status can be loosen or the periphery deforms per se; however the presence of wall section 51C prevents those accidents. Wall section 51C can be split to pieces of adequate sizes for fingers not to hit the periphery of first member 21.

On the other hand, second member 31 is press-fitted to first member 21, so that first antenna element 11 is formed. As shown in FIG. 2, second member 31 comprises the following elements:

- joining section 32 to be disposed beneath the bottom face of base 51;
- vertical section 33 disposed at the front end of joining section 32; and
- cantilever-type leaf spring 35 disposed on the back side of joining section 32.

Vertical section 33 is bent upward at right angles with respect to joining section 32 and shapes like a rectangle, and has claw section 34 at its end. Both of vertical section 33 and claw section 34 are shaped to be accommodated in protective hole 52 provided at left-front of base 51 and shown in FIGS. 5 and 6. Leaf spring section 35 extends its upper arm from joining section 32 toward the back side, and is bent downward at its middle section, namely, leaf spring section 35 forms a cantilever-type leaf spring. A lateral view of the bent portion of spring section 35 shapes like a letter "V". Second member 31 is unitarily formed by punching and bending a good conductive and elastic metal plate including copper. Joining section 32 has plural through holes 32A to be used for riveting.

Second member 31 is combined with base 51 from the bottom of base 51 such that vertical section 33 and claw section 34 are accommodated in protective hole 52. On the bottom face of base 51, cylindrical protrusions 51A corresponding to through holes 32A are provided, and they protrude downward. Protrusions 51A are inserted into through holes 32A, and their ends are riveted, so that second member 31 is fixed to the bottom face of base 51.

A lower end of the free end of spring section 35 protrudes by a given amount from the bottom face of base 51, and this protrusion works as a power feeder.

Claw section 34 of second member 31 and plate section 24 of first member 21 are press-fitted and coupled together, then both of them are accommodated in protective hole 52 of base 51 together with vertical section 33. FIG. 7 shows only the respective members of first and second antenna elements 11, 41, where the respective members are ready to be press-fitted, and this state illustrates a positional relation of the press-fit more clearly. In FIG. 7, the arrow marks confronting each other show the direction of the press-fit. Plate section 24 and claw section 34 of first antenna element 11 are press-fitted to each other.

Claw section 34 is formed of three claws 34A, 34B, 34C arranged at given intervals. Terminal claws 34A and 34C provided on both ends are urged against a first face of plate section 24, and center claw 34B is urged against a second face of plate section 24, so that first member 21 and second member 31 are press-fitted to each other.

Plate section 24 is sandwiched by claws 34A, 34C and 34B at its front and rear faces for press-fitting as discussed above, so that the joining section of press-fit can be thus simply structured. This structure allows bringing claw section 34 into contact with a wide area of plate section 24, so that stable electrical and mechanical coupling can be expected.

To be more specific about the structure of claw section 34, terminal claws 34A and 34C on both the ends are formed on the same plane as vertical section 33, and center claw 34B only is bent at its root in accordance with the thickness of plate section 24. This structure is preferable because claws 34A and 34C deviate in less amount from each other. A distance between the confronting faces of claw 34B and claw 34A, 34C is set such that the distance is approx. equal to the thickness of plate section 24 at the root of claw 34B, and a smaller distance at the end of claw 34B, so that a desirable retaining force by the press-fit can be obtained with ease.

The place where second member 31 is placed on base 51 is also surrounded by wall section 51C as first member 21 is surrounded.

As discussed above, first antenna element 11 includes first member 21 and second member 31 individually formed, and the respective members have the press-fit joining sections at their ends. The joining sections are press-fitted to each other, thereby forming one first antenna element 11.

The press-fit joining section of first antenna element 11 thus joined extends through protective holes 52 provided through base 51 vertically, so that base 51 is sandwiched by first member 21 and second member 31 at its top face and bottom face. This structure allows the press-fit joining section not to expose itself to the outside, but to be accommodated in protective holes 52, and yet, the joining section can be placed at the lateral side of base 51. Although they take irregular forms, but the top face and the bottom face of base 51 can provide necessary areas with ease for placing essential sections of the antenna element. Those areas are thus practically used. The antenna element must be matched with a desired frequency, so that the foregoing structure allows providing the antenna element with enough space for this purpose.

Joining section 23 and plate section 24 form right angles, and joining ection 32 and vertical section 33 also form right angles, so that external pressing force is applied to each one of the joining sections, thereby allowing smooth press-fit.

On top of that, the other ends of the press-fit joining sections of first and second members 21, 31 are riveted to base 51, so that unnecessary load is rarely applied to the press-fit joining section. As a result, the press-fitted state can be steadily maintained for a long term. The riveting can be done such that base 51 is sandwiched vertically from the top and the bottom, so that the riveting with excellent productivity is expected.

Next, second antenna element 41 is described hereinafter. As shown in FIG. 1, second antenna element 41 has a structure similar to that of first antenna element 11, e.g. first member 61 and second member 71 are press-fitted to each other. First member 61 is riveted to the top face of base 51, and as shown in FIG. 4 second member 71 is riveted to the bottom face of base. The press-fit joining section between first members 61 and second member 71 is placed in protective hole 52 extending through base 51 vertically. Thus the details of a similar structure to those of first antenna element 11 are omitted here. Second antenna element 41 is spaced out from first antenna element 11 at a given distance and fixed to base 51.

As shown in FIG. 1 and FIG. 5, first member 61 comprises the following elements:

linear section 62;

joining section 63 shaping like a rectangle with a narrow width and coupling to linear section 62; and press-fitting plate section 64.

Linear section 62 shapes like a letter "L" and is formed of linear area 62B extending to both sides by a given length and linear area 62C extending to the front and the rear by a given length. Linear section 62 has a shorter length than linear section 22 of first antenna element 11, and is coupled to joining section 63 at its linear area 62C, which is formed of two portions, i.e. a portion on the same plane as linear area 62B and another portion bent by a given angle to be on the same plane as joining section 63. Joining section 63 has flat press-fitting plate section 64 at its another end than the one coupled to linear section 62, and plate section 64 is bent downward by right angles with respect to joining section 63. Plate section 64 corresponds to plate section 24 of first antenna element 11. First member 61 of second antenna element 41 is formed by punching and bending a good conductive metal plate including copper, and the respective sections are unitarily formed. Those points are the same as the first antenna element 11.

First member 61 is placed on base 51, and linear section 62 is spaced out from slanting face 25 of first antenna element 11 at a given distance, and the front half of linear section 62 is placed on slanting face 51B.

On the other hand, second member 71 of second antenna element 41 is spaced out from second member 31 of first antenna element 11 at a given distance and placed more inside of base 51 than member 31 as shown in FIGS. 2 and 4. Second member 71 is formed of joining section 72, vertical section 73, claw section 74 and leaf spring section 75 as shown in FIG. 6. Joining section 72 is placed beneath the bottom face of base 51 and has vertical section 73 shaping like a rectangle at its front end. Vertical section 73 is bent upward by right angles with respect to joining section 72, and has claw section 74 at its end. Joining section 72 has leaf spring section 75 at its rear end, and spring section 75 forms a cantilever-type leaf spring and its upper arm extends backward. Leaf spring section 75 bends downward at its middle portion, so that the lateral view of spring section 75 shows like a letter "V". Spring section 75 works as a power feeder. Claw section 74 of second member 71 corresponds to claw section 34 of first antenna element 11, and has the same structure as claw section 34. Second member 71 is formed by punching and bending an elastic good conductive metal plate including copper, and the respective sections are formed unitarily. Those points are also the same as first antenna element 11.

As shown in FIG. 5, first member 61 is placed on the top face of base 51 by inserting protrusions 51A into through holes 62A, 63A provided to linear section 62 and joining section 63. As shown in FIG. 1, ends of protrusions 51A are riveted, so that first member 61 is fixed to base 51. As shown in FIG. 6, second member 71 is placed beneath the bottom face of base 51 by inserting protrusions 51A into through holes 72A, and as shown in FIG. 2, ends of protrusions 51A are riveted, so that second member 71 is fixed to base 51.

Plate section 64 of first member 61 is press-fitted to claw section 74 of second member 71 vertically along the arrow marks in FIG. 7 with first member 61 and second member 71 riveted to base 51. The press-fit joining section is accommodated in protective hole 52 provided to base 51 as shown in FIGS. 3 and 4. This structure is also the same as the first antenna element 11. On top of that, the place where second antenna element 41 is placed is also surrounded by wall section 51C of base 51 so that periphery of element 41 will not protrude outside.

As discussed above, antenna 10 of the present invention is formed by riveting first antenna element 11 and second antenna element 41 to base 51. Both of elements 11 and 41 are not formed by insert-molding but formed respectively by press-fitting two members to each other because they can be riveted to base 51. This structure allows keeping the mold cost down even if an external appearance of the antenna or the shape of base 51 is specified to be an irregular one, so that antenna 10 of irregular shape can be obtained at an inexpensive cost.

Splitting positions of antenna elements 11 or 41 into the respective members are preferably determined considering an yield ratio, an assembly efficiency, and the shape of base 51, and the respective members are preferably shaped in simple figures by the splitting. The press-fit joining sections corresponding to the splitting positions are preferably in simple constructions.

In this embodiment, the riveting of the first and the second member to base 51 is carried out by inserting protrusions provided on the top face into the respective through holes provided to the respective members and riveting the respective ends of the protrusions. The riveting; however, is not limited to those examples, but can be applied to the wall sections which surround the respective members placed on the base, i.e. an end of the wall section is riveted with jig for fixing the members to the base.

In this embodiment, protective holes 52 are provided to the left front of base 51; however, the location of holes 52 is not limited to this, and it can be determined considering an external appearance of antenna 10, the shape of base 51, and a location of a connecting port of the circuit pattern.

In this embodiment, three claws are available in the claw section; however, the number of claws is not limited to three, it can be two or more than two as long as the claws achieve steady press-fit.

Next, a mounting status of antenna 10 to the device is demonstrated hereinafter. Antenna 10 is positioned and fixed on the circuit board (not shown) placed within the device with screw through hole-section 55 provided to the rear part of base 51 as shown in FIGS. 1 and 2. The positioning and fixing means are not limited to the screw.

Then a given circuit pattern placed on the printed circuit board is electrically coupled to antenna 10. To be more specific, leaf spring sections 35 and 75 of second members 31, 71 which are fixed to the bottom face of base 51 have free ends respectively, and the lower ends of the free ends are urged against the corresponding patterns by elastic force, thereby achieving the electrical coupling. In other words, positioning and retaining antenna 10 with its bottom face urged against the top face of the circuit board will move the lower ends on the free-end sides of spring sections 35, 75 upward to be approximately flash with the bottom face of base 51. This mechanism bows spring sections 35, 75 by a given amount, and the elastic force thus produced urges the lower ends of spring sections 35, 75 against the given circuit patterns, so that antenna 10 is electrically connected to the circuit patterns.

Spring sections 35, 75, which work as power feeders, are thus not soldered, and yet, the circuit patterns in the device can be electrically coupled to antenna 10. This electrically coupling state tells that first and second antenna elements 11, 41 respectively function as conventional mono-pole antennas.

Coupling through urging the spring sections 35, 75 against the circuit pattern by using elastic force requires second members 31, 71 to be made of elastic and good conductive material. As discussed previously, second members 31, 71 is made of good conductive material which also meets the elasticity needed to claw sections 34, 74 to be press-fitted into first members 21, 61. Thus there is no problem to add spring sections 35, 75 to second members 31, 71. As a result, the foregoing construction reduces the number of steps of mounting antenna 10 to the device.

The elastic force of spring 35, 75 with antenna 10 mounted to the device uplifts second members 31, 71 from the lower place up to base 51. The foregoing construction is preferable because the elastic force thus scarcely influences the riveted sections to base 51 and press-fit joining sections between base 51 and first members 21, 61.

When a user operates the device routinely with antenna 10 mounted to the device, radio-wave can be received or transmitted via antenna 10, so that communication can be done as the conventional devices have done. When first antenna element 11 and second antenna element 41 employ different effective antenna lengths from each other, antenna 10 can handle multi-frequencies because respective elements can receive or transmit radio-wave at frequencies corresponding to the respective antenna lengths.

In this embodiment, two antenna elements 11, 41 having constructions similar to each other are fixed to base 51; however, the number of antennas is not limited to two, and some antenna elements among from plural antenna elements can be selected for constructing an antenna. One antenna element can be formed by combining three or more than three members.

A method of joining the respective members to each other is not limited to the press-fit, however, the respective members are preferably fixed to the base by riveting, because the riveting does not apply extra load to the joint, and yet, produces necessary fixing force with ease.

Exemplary Embodiment 2

Figure 8:
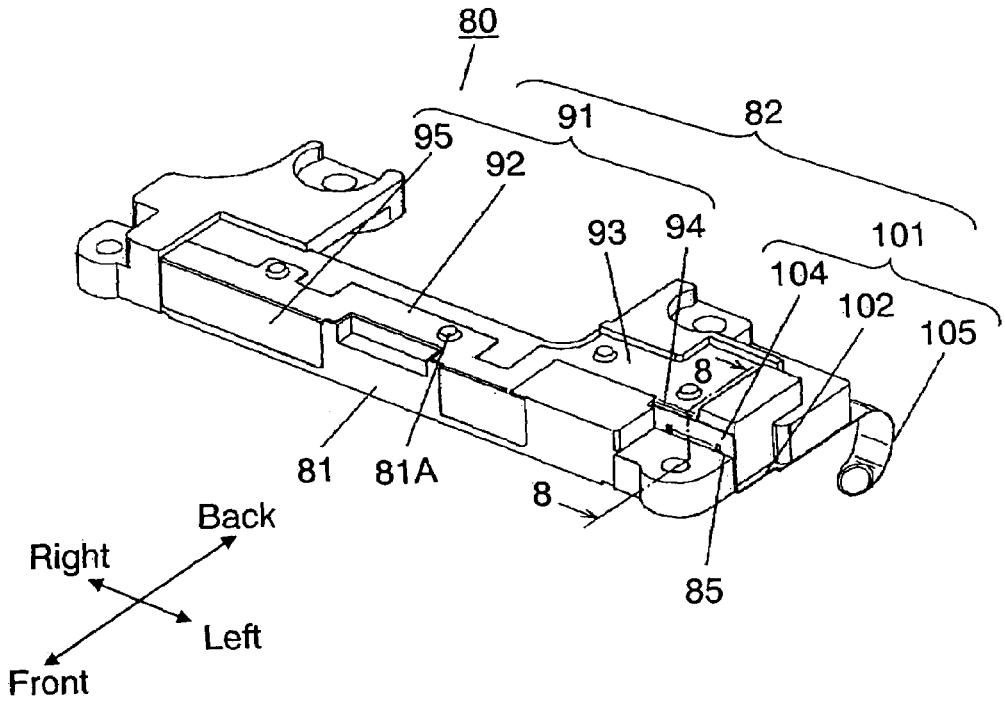
FIG. 8 shows a perspective view illustrating an external appearance of an antenna in accordance with a second exemplary embodiment of the present invention, and the view is taken obliquely from the front and over the antenna and shows a sectional view of an essential part of the antenna.
Figure 9:
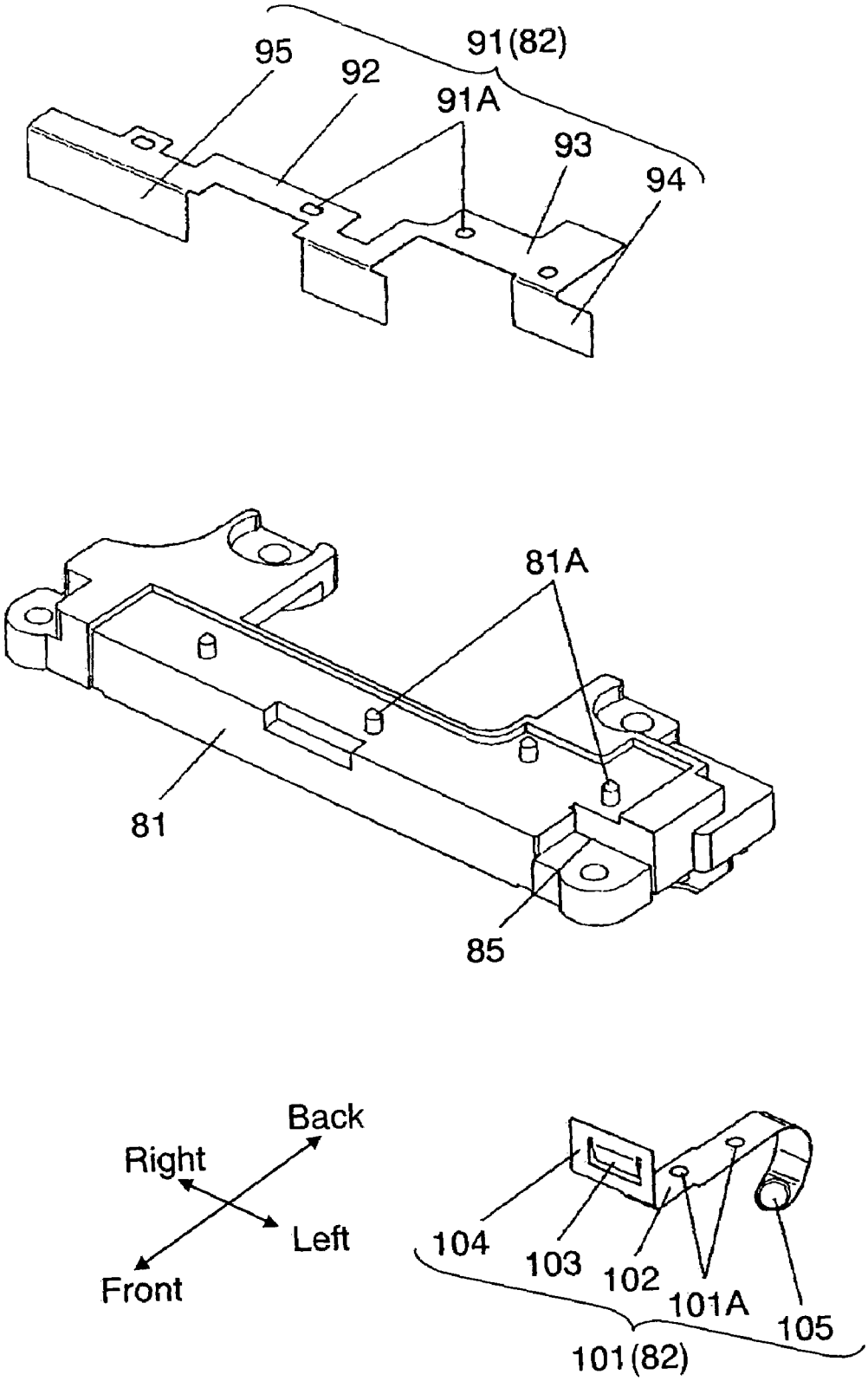
FIG. 9 shows an exploded view of the antenna shown in FIG. 8.
Figure 10:
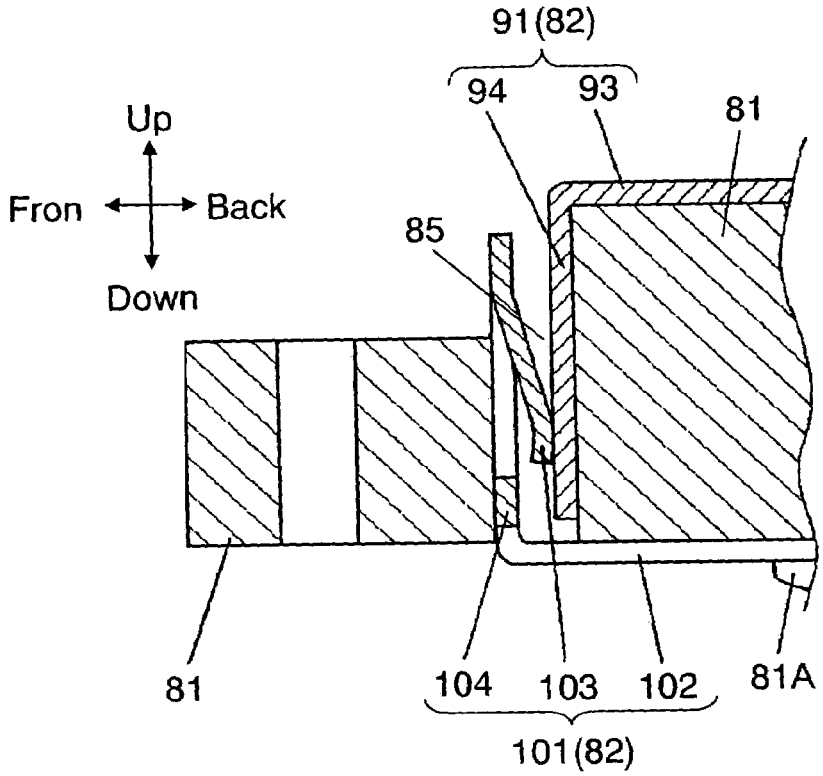
FIG. 10 shows a sectional view taken along the line 8-8 in FIG. 8.
Figure 11:
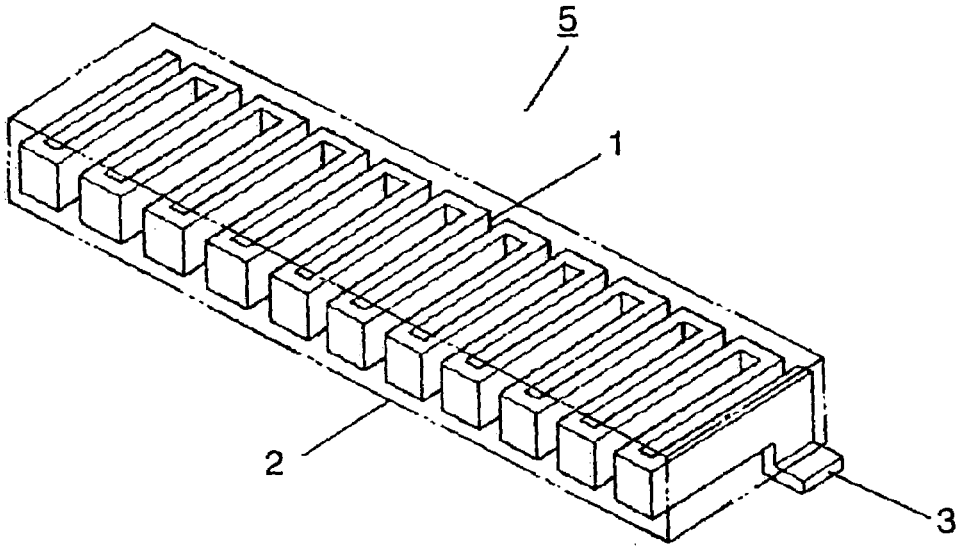
FIG. 11 Prior Art
FIG. 11 shows a perspective view illustrating a conventional built-in antenna.

FIG. 8 shows a perspective view illustrating an antenna in accordance with the second exemplary embodiment of the present invention, and the view is taken obliquely from the front and over the antenna. FIG. 9 shows an exploded view of the antenna shown in FIG. 8. FIG. 10 shows a sectional view taken along the line 8-8 in FIG. 8.

As those drawings show, antenna 80 in accordance with the second embodiment comprises the following elements:

base 81 made of insulating resin and formed into a given shape; and one antenna element 82 fixed to base 81.

Antenna element 82 is formed of first member 91 placed on the top face of base 81 and second member 101 placed beneath the bottom face of base 81. Those two members are press-fitted to each other as those of the first embodiment.

First member 91 placed on the top face of base 81 is formed by punching and bending a good conductive metal plate including copper. First member 91 comprises the following elements:

meandering linear section 92;

joining section 93 shaping like a rectangle and extending from linear section 92 on the same plane;

flat urging plate section 94; and face section 95.

Urging plate section 94 is bent downward by right angles with respect to joining section 93 at the left front end of joining section 93. Face section 95 is bent downward by right angles at the front of linear section 92.

Second member 101 placed beneath the bottom face of base 81 is formed by punching and bending an elastic good conductive metal plate including copper. As shown in FIG. 9, second member 101 includes joining section 102 having a narrow width, frame-like vertical section 104, and spring section 105. Frame-like vertical section 104 is bent upward by right angles with respect to joining section 102 at the front end of joining section 102, and has elastic tab 103. Spring section 105 is a cantilever type spring, and its upper arm extends from joining section 102 toward the back. Spring section is bent downward at its middle part. A lateral view of spring section 105 shows like a letter "V". Frame-like vertical section 104 with elastic tab 103 works as an urging joining section of the second member 101.

Frame-like vertical section 104 has an external appearance of approx. rectangle, and the rectangle has a cutout portion therein. Elastic tab 103 is formed in the cutout portion. In other words, the upper end of tab 103 connects to the upper side of the cutout portion, and the lower end of tab 103 slants away from vertical section 104 toward the back. When frame-like vertical section 104 is formed, the rectangle is punched out at the center of section 104 except its upper side, namely, the other three sides are punched, so that a primary form of tab 103 is formed. The inside of the punched portion is bent to slant for forming elastic tab 103.

First member 91 and second member 101 are urged against each other vertically as the first embodiment does. Protective hole 85 is provided at the left front of base 81 and extends through base 81 vertically. In protective hole 85, plate section 94 and vertical section 104 with tab 103 are urged against each other vertically, so that plate section 94 is coupled to vertical section 104. Plate section 94 and vertical section 104 with tab 103 are placed on the top face and the bottom face of base 81 respectively. Both of the top and bottom faces of base 81 have protrusions 81A (not shown in FIG. 8 or FIG. 9) for riveting. First and second members 91 and 101 are positioned on base 81 by inserting protrusions 81A into their through-holes 91A and 101A. Then the ends of protrusions 81A are riveted for fixing first and second members 91 and 101 to base 81. Protective hole 85 in accordance with the second embodiment has an opening at its one side, and its top view shows like a rectangle.

As shown in FIG. 10, in protective hole 85, plate section 94 confronts frame-like vertical section 104 with elastic tab 103 in between. Tab 103 is urged toward vertical section 104 by the front face of plate section 94, and bows forward by a given amount using the root of tab 103 as a fulcrum. Tab 103 is urged against the front face of plate section 94 by the elastic force of tab 103, so that tab 103 is coupled to plate section 94. The rear face of plate section 94 and the front face of vertical section 104 are urged respectively against front and rear inner walls of base 81, which are parts of protective hole 85, by the elastic force.

The foregoing shape of protective hole 85 allows monitoring the joint from the opening disposed at the lateral side of hole 85. If tab 103 is positioned inside frame-like vertical section 104, both the lateral sides of vertical section 104 can protect the joint. The joint can be structured such that first member 91 and second member 101 sandwich parts of base 81, and the joint can be placed in protective hole 85. Those structures remain unchanged from the first embodiment.

Joining section 93 is square to plate section 94, and joining section 102 is square to frame-like vertical section 104. Thus external force is applied to the joint at the press-fitting of those elements, thereby achieving smooth press-fitting.

Joining sections 93 and 102 sandwich parts of base 81 vertically and they are riveted to base 81, so that the steady joint can be maintained for a long term as is the first embodiment.

In this second embodiment, protective holes 85 are provided to the left front of base 81; however, the location of holes 85 is not limited to this, and it can be determined considering an external appearance of antenna 80, the shape of base 81, and a location of a connecting port of the circuit pattern.

Mounting of antenna 80 to the device is the same as discussed in the first embodiment, so that the description thereof is omitted here.

Antenna element 82 is not formed by insert-molding but formed by press-fitting first member 91 and second member 101, which have been individually formed, to each other and they are riveted to base 81. This structure allows keeping the mold cost down even if an external appearance of antenna 80 is required to be an irregular one, so that antenna 80 can be obtained at an inexpensive cost.

Elastic tab 103 urges itself against plate section 94 by its elastic force at the joint, to be more specific, plate section 94 is inserted into protective hole 85 from the top and frame-like vertical section 104 with tab 103 is inserted into hole 85 from the bottom, thereby achieving the joint. It is a very simple work. Since elastic tab 103 is disposed in second member 101, spring section 105 functioning as a power feeder can be formed in second member 101 with ease, and this structure remain unchanged from the first embodiment.

In this second embodiment, urging plate section 94 of first member 91 is urged against elastic tab 103 of second member 101 for achieving the joint; however, a form of the joint is not limited to this example. When at least one antenna element is formed of plural members, the joints between the plural members can be formed by urging the respective members against each other.

INDUSTRIAL APPLICABILITY

If an external appearance of an antenna is specified to be not a rectangle but an irregular shape, the present invention allows advantageously constructing the antenna to fit the irregular appearance at an inexpensive cost. Such an antenna is useful for mobile communication devices including portable phones.

What is claimed is:

1. An antenna of comprising:

an antenna element made of metal plate and having a first member and a second member;

a base to which the antenna element is fixed; and a protective hole provided to the base and extending through the base, wherein the first member includes a joining section at an end of the first member and a fixing section having a through hole, wherein the second member includes a joining section coupled to the joining section of the first member and disposed at a first end of the second member, a fixing section having a through hole, and a plate section disposed at a second end of the second member, wherein the base includes a protrusion for riveting which correspond to the each through hole of the first member and of the second member, wherein the joining section of the first member and the second member are disposed in the protective hole.

2. The antenna of claim 1, wherein the joining sections of the first member and the second member are press-fitted to each other, so that each one of the two joining sections forms a press-fitting joining section, and the press-fitting joining section includes a urging plate section, a frame-like vertical section, and an elastic tab, which is a cantilever-type leaf spring, protruding from a surface of the frame-like vertical section.

3. The antenna of claim 2, further comprising a wall section provided to the base for surrounding the respective peripheries of the first and the second members.

4. The antenna of claim 1, further comprising a wall section provided to the base for surrounding the respective peripheries of the first and the second members.

5. An antenna comprising:

an antenna element made of metal plate and having a first member and a second member; and a base to which the antenna element is fixed, wherein the first member includes a joining section at an end of the first member and a fixing section having a through hole, wherein the second member includes a joining section coupled to the joining section of the first member and disposed at a first end of the second member, a fixing section having a through hole, and a plate section disposed at a second end of the second member, wherein the base includes a protrusion for riveting which correspond to the each through hole of the first member and of the second member, wherein the joining sections of the first member and the second member are press-fitted to each other, so that each one of the two joining sections forms a press-fitting joining section.

6. The antenna of claim 5, wherein the press-fitting joining section includes a press-fitting plate section and a claw section which sandwiches the plate section at both faces of the plate section.

7. The antenna of claim 6, further comprising a wall section provided to the base for surrounding the respective peripheries of the first and the second members.

8. The antenna of claim 5, further comprising a wall section provided to the base for surrounding the respective peripheries of the first and the second members.

9. An antenna comprising:

an antenna element made of metal plate and having a first member and a second member; and a base to which the antenna element is fixed, wherein the first member includes a joining section at an end of the first member and a fixing section having a through hole, wherein the second member includes a joining section coupled to the joining section of the first member and disposed at a first end of the second member, a fixing section having a through hole, and a plate section disposed at a second end of the second member, wherein the base includes a protrusion for riveting which correspond to the each through hole of the first member and of the second member, wherein the fixing sections of the first member and the second member confront each other and sandwich the base, and each one of the fixing sections forms right angles with the corresponding joining sections.

10. The antenna of claim 9, further comprising a wall section provided to the base for surrounding the respective peripheries of the first and the second members.

11. An antenna comprising:

an antenna element made of metal plate and having a first member and a second member; and a base to which the antenna element is fixed, wherein the first member includes a joining section at an end of the first member and a fixing section having a through hole, wherein the second member includes a joining section coupled to the joining section of the first member and disposed at a first end of the second member, a fixing section having a through hole, and a plate section disposed at a second end of the second member, wherein the base includes a protrusion for riveting which correspond to the each through hole of the first member and of the second member, wherein the second member includes a cantilever-type leaf spring disposed at an extension of the second member, and power feeder is provided to a part of the leaf spring, so that the power feeder is urged against a circuit pattern of a device by elastic force of the leaf spring, and the circuit pattern can power the antenna.

12. The antenna of claim 11, further comprising a wall section provided to the base for surrounding the respective peripheries of the first and the second members.

* * * * *

UNITED STATES PATENT AND TRADEMARK OFFICE

CERTIFICATE OF CORRECTION

PATENT NO. : 7,342,542 B2
APPLICATION NO. : 11/285626
DATED : March 11, 2008
INVENTOR(S) : Sadamori et al.

It is certified that error appears in the above-identified patent and that said Letters Patent is hereby corrected as shown below:

In column 11, line 24 of the Letters Patent, in claim 1 (Amendment claim 2), "An antenna of comprising" should read --An antenna comprising--.

In column 12, line 59 of the Letters Patent, in claim 11 (Amendment claim 7), "member, and power feeder" should read --member, and a power feeder--.

Signed and Sealed this

Fifteenth Day of July, 2008

JON W. DUDAS
*Director of the United States Patent and Trademark Office*